US006117608A

United States Patent [19]

Aoyagi et al.

[11] Patent Number: 6,117,608

[45] Date of Patent: Sep. 12, 2000

[54] LIQUID TONER CONTAINING FOAMING INHIBITOR, FOAMED PRODUCT, FOAMABLE INTERMEDIATE PRODUCT AND METHOD OF PRODUCING OR MANUFACTURING SAME

[75] Inventors: Makoto Aoyagi; Katsuya Teshima, both of Tokyo-to, Japan

[73] Assignee: Dai Nippon Printing Co., Ltd., Tokyo-to, Japan

[21] Appl. No.: 09/281,196

[22] Filed: Mar. 30, 1999

[30] Foreign Application Priority Data

Mar. 31, 1998 [JP] Japan ..... 10-087681

[51] Int. Cl.[7] ..... G03G 9/13

[52] U.S. Cl. ..... 430/115

[58] Field of Search ..... 430/115

[56] References Cited

U.S. PATENT DOCUMENTS 5,096,781 3/1992 Vieira et al. ..... 430/115

FOREIGN PATENT DOCUMENTS 2-153363 6/1990 Japan ..... 430/115

*Primary Examiner*—Roland Martin
*Attorney, Agent, or Firm*—Ladas & Parry

[57] ABSTRACT

A liquid toner of the present invention comprises particles containing a foaming inhibitor and an electrically insulating dispersion medium dispersing the particles therein. One preferred liquid toner comprises copolymer resin particles and an electrically insulating dispersion medium, the copolymer resin particles containing a copolymer resin composed of at least two different monomer components including a first and a second monomer components and a foaming inhibitor, and the copolymer resin particles being dispersed in the dispersion medium, wherein the copolymer resin and the dispersion medium are related to each other such that (i) a difference $\Delta(\delta p^1-\delta d)$ between a SP value $\delta p^1$ of a homopolymer composed only of the first monomer component and a SP value $\delta d$ of the dispersion medium is not smaller than 1.0, (ii) a difference $\Delta(\delta p^2-\delta d)$ between a SP value $\delta p^2$ of a homopolymer composed only of the second monomer component and the SP value $\delta d$ is not larger than 1.0, and (iii) a difference $\Delta(\delta p^1-\delta p^2)$ is at least 0.5, and each of said copolymer resin particles has a configuration in which a core portion insoluble in the dispersion medium is surrounded with an outer skin portion soluble or swellable in the dispersion medium. A foamed product having a convexo-concave pattern is formed by applying the foaming inhibitor on a foamable preform in a prescribed pattern via an on-demand printing method such as an electrostatic record or an electrostatic image transfer with the use of the above described liquid toner, and then foaming same.

4 Claims, 4 Drawing Sheets

C-C SECTION

LIQUID TONER CONTAINING FOAMING INHIBITOR, FOAMED PRODUCT, FOAMABLE INTERMEDIATE PRODUCT AND METHOD OF PRODUCING OR MANUFACTURING SAME

BACKGROUND OF THE INVENTION

1. Field of the Invention

The present invention relates to a method of manufacturing a foamed product having a convexo-concave surface in which a foaming inhibitor is coated on or infiltrated into a surface of a foamable preform made of a foamable resin composition in a prescribed pattern and then the preform is foamed, and it further relates to a foamed product obtained through such a method and a material usable for such a method.

More specifically, the present invention relates to a liquid toner containing a foaming inhibitor, a method of a foamed product having a convexo-concave pattern involving a step where the foaming inhibitor is coated on or infiltrated into a surface of the foamable preform in a prescribed pattern though an electrostatic technique such as an electrostatic record or an electrostatic image transfer, and further relates to an intermediate product and a convexo-concave foamed product obtained though such a method.

2. Description of the Related Art

There has been known a printed product, an interior material and building material having a three dimensional pattern or a relief pattern, such as a foamed wall paper, a foamed flooring material or the like. They have been manufactured by a "chemical emboss" process. In the chemical emboss process, a foaming inhibitor is applied on a surface of a foamable preform made of a foamable resin composition in a prescribed pattern to form a pattern of a coating or infiltrated portion containing the foaming inhibitor, and then the foamable preform is foamed by heating or another manner. Thus a portion of the preform with no foaming inhibitor is foamed to rise or bulge while the other portion of the preform at which the foaming inhibitor is present is not foamed to be left unchanged, thereby forming a foamed product which has a surface provided with a convexo-concave pattern. The thus formed convexo-concave pattern is according to the pattern of the applied foaming inhibitor, and it makes up a three dimensional pattern (or a relief pattern) provided on the surface of the foamed product. The printed product and the other articles having a three dimensional pattern is manufactured through such a chemical emboss process. The chemical emboss process is disclosed in Japanese Patent Publication(Kohkoku) Nos. Sho 43(1968)-28636 and Japanese Patent Publication(Kohkoku) Nos. Sho 47(1972)-29187.

One of the known foamable resin composition is composed of polyvinyl chloride resin, a foaming agent such as azodicarbonamide, and a foaming accelerator such as zinc naphthenate. The foaming agent such as azodicarbonamide is decomposed by heating and generates gases such as carbon dioxide to form bubbles in the foamable resin composition. The foaming accelerator such as zinc naphthenate acts as a catalyst for decomposition of the foaming agent to lower a decomposition temperature. On the other hand, there has been used, as the foaming inhibitor, benzotriazole compounds or the like capable of inhibiting an effect of the foaming accelerator. When the foaming inhibitor is applied on the surface of the foamable preform made of the foamable resin composition, a foaming temperature of the portion retaining the foaming inhibitor gets higher than that of the other portion of the surface with no foaming inhibitor. Accordingly, if heating temperature of the foamable preform is controlled within at least a foaming temperature of the portion retaining no foaming inhibitor while under a foaming temperature of the portion retaining the foaming inhibitor, it is possible to foam only at the portion retaining no foaming inhibitor.

In the known art, the foaming inhibitor has been patternwise applied on the surface of the foamable preform by gravure printing, offset printing or the like, which need to use a form plate. Such a conventional process accordingly has suffered from a relatively long time and a large cost to make the form plate, whereby it has been involved in a problem that it is impossible to make preparation and evaluation of a prototype quick or smooth in a research and development stage.

As the other method substituting for the actual preparation of the prototype, it may be worth while considering a method in which a design of the surface of the prototype is generated and reproduced on a monitor through a digital process, and the thus reproduced image of the design is quickly output by means of an on-demand type printer such as an electrostatic plotter, an electrophotographic printer or the like to obtain a two dimensional sample of the design. When a sample of an ordinary printed product or publication is required, it is possible to generate and output an image very similar to a true image of a final product or a prototype in a short time by means of some digital proof printer, thereby carrying out preparation and evaluation of the proof in a sufficient mobility. However, since the foamed product having a convexo-concave surface largely varies its design or appearance including impression, texture or the like through the foaming process, even the digital proof printer can not generate the image very similar to the surface design of the final product or prototype. Accordingly it has been impossible to carry out an exact evaluation of the foamed product by this method.

For that reason, a designer or another product developer who studies the foamed product having a three dimensional pattern such as the wall paper, the foamed flooring or the like has not been allowed to prepare the prototypes frequently in the development stage, while he has been usually checked nothing but a montage image which is output by the digital proof printer and however reproduced not so exactly in order to perform the product development, and therefore it has been difficult to evaluate the design of the convexo-concave pattern of the surface in detail.

In addition, it is desirable for presentation of the foamed product to use a sample same as or very similar to an actual final product so as to demonstrate the design thereof sufficiently to the user. Preparation of the exact sample however needs to prepare the form plate for applying of the foaming inhibitor, thereby causing difficulties in time schedule and cost. Therefore, it has been difficult to perform the presentation of the foamed product in a sufficient mobility.

SUMMARY OF THE INVENTION

An object of the present invention is to easily and quickly form a coating or infiltrated portion containing the foaming inhibitor in a desired pattern on a surface of a foamable preform without the use of the form plate, but by means of an on-demand type printer such as an electrostatic plotter, an electrophotographic printer or the like.

To attain the above object, the present invention provides a liquid toner in which toner particles containing a foaming inhibitor are dispersed. Further, the present invention provides methods for producing such a liquid toner. Still further, the present invention provides methods for manufacturing a foamed product having a convexo-concave pattern and an intermediate product thereof, in which the foaming inhibitor is made adhere on or infiltrate into a surface of a foamed preform via an on-demand type printing method. Still further, the present invention provides the convexo-concave foamed product and the intermediate product thereof manufactured by such methods.

The liquid toner of the present invention comprises fine particles containing a foaming inhibitor affecting a foamable resin composition and an electrically insulating dispersion medium, wherein the fine particles are dispersed in the electrically insulating dispersion medium.

In one preferred embodiment, the liquid toner of the present invention comprises copolymer resin particles and an electrically insulating dispersion medium, the copolymer resin particles containing a copolymer resin composed of at least two different monomer components including a first and a second monomer components and a foaming inhibitor affecting a foamable resin composition, and the copolymer resin particles being dispersed in the electrically insulating dispersion medium, wherein said copolymer resin and said electrically insulating dispersion medium are related to each other such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5, and each of said copolymer resin particles has a configuration in which a core portion insoluble in the electrically insulating dispersion medium is surrounded with an outer skin portion soluble or swellable in the electrically insulating dispersion medium.

In such a liquid toner, trimellitic anhydride and/or benzotriazole is preferably used as the foaming inhibitor.

The above described liquid toner may be produced in such manner that resin particles are precipitated out from a liquid dissolving or dispersing the foaming inhibitor and the resin therein by taking change of solubility of the used resin. Each precipitated resin particle has a configuration in which a surface of a fine particle of a foaming inhibitor is covered with a resin and also has capability to be dispersed in an electrically insulating dispersion medium One preferred producing method comprises the steps of:

providing a solution prepared by dissolving or dispersing a copolymer resin composed of at least two different monomer components including a first and a second monomer components in the solvent;

further providing the electrically insulating dispersion medium being related to the copolymer resin such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5;

mixing the solution of the copolymer resin with the dispersion medium in the presence of the foaming inhibitor affecting a foamable resin composition with a condition keeping a dispersed state of the foaming inhibitor; and removing the solvent from the mixture after mixing of the dispersion medium.

In the above mentioned method, the liquid toner is produced by mixing a solution of the copolymer resin in a good solvent such as toluene with the electrically insulating dispersion medium in the presence of the foaming inhibitor such as trimellitic anhydride to cause granulation of the copolymer resin particles, and then removing the good solvent as required.

The electrically insulating dispersion medium to be preferably used in the present invention has a solubility parameter value (SP value) defined as "$\delta d$", and $\delta d$ of the dispersion medium has a relationship such that a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, and that a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0. That is, the dispersion medium to be used in the present invention has a low affinity to the first monomer component of the copolymer resin, while has a high affinity to the second monomer component of the copolymer resin. In addition, a difference $\Delta(\delta p^1-\delta p^2)$ between the two solubility parameter values $\delta p^1$ and $\delta p^2$ of those homopolymers is at least 0.5. Accordingly, there is a considerable gap between the affinity presented for the portion of the first monomer component by the dispersion medium and the other affinity presented for the portion of the second monomer component by the dispersion medium.

For that reason, when a solution or varnish containing the above described copolymer resin composed of at least the first and the second monomer components is mixed with the electrically insulating dispersion medium having such a characteristics of SP value as described above in the presence of the foaming inhibitor which is essentially little in affinity to the electrically insulating dispersion medium, a portion of the first monomer component in the copolymer resin is repelled by the dispersion medium to be adsorbed on or adhere to a surface of the foaming inhibitor. As the result, the copolymer resin microscopically aggregates so as to surround the foaming inhibitor serving as a core, thereby foaming the copolymer resin particles containing the foaming inhibitor.

Each of the copolymer resin particle thus formed is composed of a core portion which is insoluble in the dispersion medium and an outer skin portion which is soluble or swellable in the dispersion medium and surrounding the core portion. The core portion is composed mainly of the foaming inhibitor and portions which are incorporated in a molecule of the copolymer resin and have a high affinity to the foaming inhibitor, particularly the first monomer component. On the other hand, the outer skin portion is composed mainly of portions which are incorporated in a molecule of the copolymer resin and have a high affinity to the electrically insulating dispersion medium, particularly the second monomer component. Since the copolymer resin particles have such a configuration, particles of the foaming inhibitor as the core are prevented from coming into a direct contact with each other and stably dispersed in the dispersion medium, thus preventing occurrence of precipitation or a macroscopic aggregation of the copolymer resin particles. In addition, the liquid toner of the present invention also has a good electrification characteristics. Accordingly, when an electrostatic latent image is developed with the use of the liquid toner of the present invention, a pattern coincident with the latent image and containing the foaming inhibitor can be made.

The liquid toner containing the foaming agent may be produced the other method. For example, the other preferred method may comprise the steps of:

providing the foaming inhibitor affecting a foamable resin composition;

further providing a copolymer resin composed of at least two different monomer components including a first and a second monomer components;

further providing the electrically insulating dispersion medium being related to the copolymer resin such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5;

adding the copolymer resin in the dispersion medium and dissolving it by heating, while adding the foaming agent in the dispersion medium at the same time or a different time and dispersing it to prepare a heated mixture containing the dissolved copolymer resin and the dispersed foaming agent; and cooling the heated mixture.

In the present invention, a foamable intermediate product can be manufactured by: (1) providing a foamable preform having a foamable portion made of a foamable resin composition; (2) further providing a recording material containing a foaming inhibitor which is usable for a printing method based on an on-demand system capable of outputting an image directly on an receiving material according to electric, thermal or optical record signals; and then (3) applying the recording material on the foamable preform by the printing method based on an on-demand system to make the recording material containing the foaming inhibitor adhere on or infiltrate into a surface of the foamable portion in a prescribed pattern.

Further, when the foamable portion of the thus prepared foamable intermediate product is foamed by, for example, heating, a surface of the intermediate product is formed into a convexo-concave pattern, thereby obtaining a foamed product of the present invention.

In one preferred embodiment, the manufacturing method comprises the steps of:

providing the foamable preform having a foamable portion made of a foamable resin composition;

further providing a liquid toner, as said recording material, in which copolymer resin particles are dispersed in an electrically insulating dispersion medium, the copolymer resin particles containing a copolymer resin composed of at least two different monomer components including a first and a second monomer components and a foaming inhibitor affecting the foamable resin composition, the copolymer resin and the electrically insulating dispersion medium being related to each other such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5, and each of said copolymer resin particles having a configuration in which a core portion insoluble in the electrically insulating dispersion medium is surrounded with an outer skin portion soluble or swellable in the electrically insulating dispersion medium;

subjecting the foamable preform to an electrostatic record or an electrostatic image transfer with the use of the liquid toner to apply the copolymer resin particles on a surface of the foamable portion in a prescribed pattern; and foaming the foamable portion after the applying of the copolymer resin particles to form the surface of the foamable portion into a convexo-concave pattern.

Since the use of the liquid toner of the present invention can form a pattern of the foaming inhibitor in accordance with the electrostatic latent image, any image-forming technique utilizing an effect of the electrostatic force, particularly an electrostatic record and an electrostatic image transfer, has come adaptable for formation of a pattern of a foamed or nonfoamed portion.

According to the manufacturing method of the present invention, an original image for the convexo-concave pattern, for example, a pattern imitating some natural article such as grain of wood or stone and an artificial pattern can be generated easily and quickly through a digital process, and then a pattern of the foaming inhibitor coincident with the thus generated original image can be easily and quickly formed on a surface of the foamable preform by the electrostatic record or the electrostatic image transfer. This manufacturing method does not require a step preparing the form plate. Therefore, it is possible to manufacture the foamed product having a convexo-concave pattern without so much time and trouble. In particular, the present invention including the liquid toner and the manufacturing method is fit to, for example, prepare prototypes frequently, prepare a sample in a hurry for completely progressing a schedule of a presentation, and otherwith, produce and supply various kinds of convexo-concave foamed products by a small quantity on some system of production on orders.

DETAILED DESCRIPTION OF THE PREFERRED EMBODIMENTS

Figure 1:
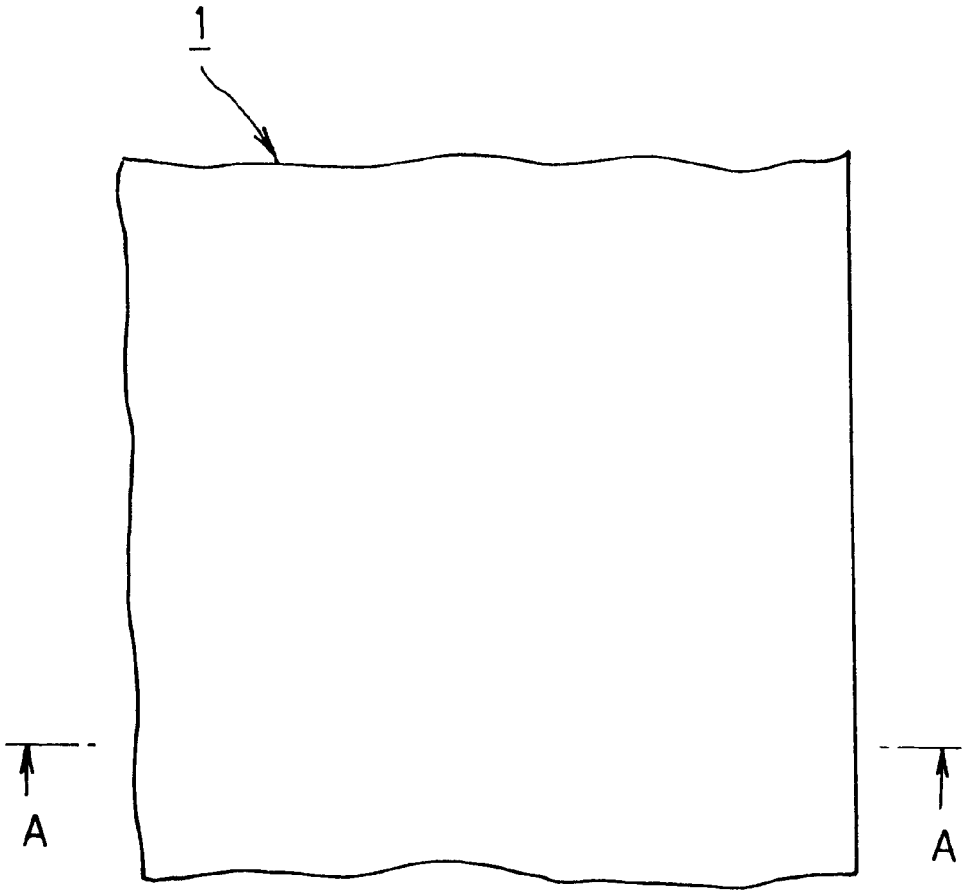
FIG. 1 is a partial plan view of one foamable preform.

The present invention will be explaining hereinafter with reference to the preferred embodiments.

(1) Foamable Resin Composition and Forming Inhibitor

A foamable resin composition to be used in the present invention is composed of at least resin, and capable of being foamed through some process such as heating or chemical reaction to form a cellular structure containing a resinous matrix and many bubbles after the foaming, and further capable of being affected by a properly selected foaming inhibitor to be wholly or partially inhibited in its forming ability.

One of the typical foamable resin compositions is a mixture containing a thermoplastic resin, a foaming agent which is decomposed by heating to generate gases and a foaming accelerator which acts as a catalyst lowering decomposition temperature (i.e., foaming temperature) of the foaming agent. A foaming inhibitor inhibiting or suppressing an effect of the foaming accelerator to raise up the decomposition temperature of the foaming agent may be used in combination with such a foamable resin composition.

As the thermoplastic resin, there may be used polyvinyl chloride resin, particularly a cellular or porous polyvinyl chloride resin. As the foaming agent, there may be used azodicarbonamide, N,N-dinitoroso pentamethylenetetramine, p-toluene sulfonyl semicarbazide, P,P'-oxybis(benzensulfonylsemicarbazide), N,N'-dimethyl-N,N'-dinitroso terephthalamide, diazoamino benzene, aminoguanidine bicarbonate, P,P'-thio-bis (benzensulfonylhydrazide), P,P'-diphenylmethane disulfonylhydrazide, benzene-m-disulfonylhydrazide, benzenesulfonylhydrazide, terephthalazide, benzazide, p-tert-butyl benzazide,, phthalazide, isophthalazide, 1,3-diphenyltriazine, azohexahydro benzonitrile or the like. As the foaming accelerator, there may be used salt of fatty acid such as zinc stearate and zinc palmitate, salt of the other organic acid such as zinc octylate and zinc naphthenate or the like. The foamable resin composition may be contain another additives such as a coloring agent, a fluorescent, a deodorant, an ultraviolet shading agent, antimicrobial agent or the like as required in order to improve, for example, a design or appearance after the forming.

As the foaming inhibitor, there is preferably used trimellitic anhydride and benzotriazole, which may be used solely or in combination with each other. Use of a foaming inhibitor being solid state in the ordinary or room temperature is required in order to convert the foaming inhibitor into the toner. Many foaming inhibitors are liquid state in the ordinary or room temperature, but trimellitic anhydride and benzotriazole are solid state in the ordinary or room temperature. A foaming inhibitor which is normally in a liquid state in the ordinary or room temperature such as maleic anhydride can also be used by converting into the solid state. The liquid foaming inhibitor may be converted into the solid state by forming into a beads-form via kneading together with a resin or capsulation.

(2) Liquid Toner and Producing Method Thereof

A liquid toner according to the present invention is composed by dispersing fine particles in an electrically insulating dispersion medium, and those particles contain a foaming inhibitor such as trimellitic anhydride.

The above mentioned liquid toner may be produced in such manner that resin particles are precipitated out from a liquid dissolving or dispersing the foaming inhibitor and the resin therein by taking change of solubility of the used resin. Each precipitated resin particle has a configuration in which a surface of a fine particle of a foaming inhibitor is covered with a resin and also has capability to be dispersed in an electrically insulating dispersion medium In one preferred method, the liquid toner may be produced, for example, by mixing a solution, which is prepared by dissolving the copolymer resin composed of at least a first and a second monomer components in a good solvent such as toluene, with the electrically insulating dispersion medium in the presence of a foaming inhibitor such as trimellitic anhydride to cause granulation of the copolymer resin particles, and then removing the good solvent as required.

According to the above method, the copolymer resin particles composed by wrapping the foaming inhibitor particles in the copolymer resin is precipitated out from a varnish or solution of the copolymer resin, and solubility parameter value (SP value) of the electrically insulating dispersion medium is adjusted in consideration of the used copolymer resin, thereby providing a liquid toner excellent in dispersing capability for the copolymer resin particles, i.e., toner particles.

(Solubility Parameter Value (SP value))

In general, SP values are known as being indicative of compatibility or incompatibility between substances. Taking the relationship between a resin and a solvent therefor by way of example, the degree of solubility of the resin in the solvent can be shown by the SP values. If the difference between the SP values of the resin and the solvent is small, the solubility of the resin in the solvent is high, whereas, if the difference is large, the solubility is low. If the difference is very large, the resin is insoluble in the solvent.

The following are examples of known methods of measuring SP values of resins:

(1) Dissolution method, i.e., a method in which the SP value of a resin is estimated from the SP value of a solvent which dissolves the resin (H. Burrell, Official Digest, 27 (369), 726 (1950));

(2) Swelling method, i.e., a method in which the SP value of a resin which is difficult to be dissolved is estimated from the SP value of a solvent which can shown the highest degree of swelling (the same as the above);

(3) Method in which the SP value of a resin is obtained from the intrinsic viscosity of the resin, i.e., a method in which, since the intrinsic viscosity of a resin in a solvent shows the largest value when the SP value of the resin and the SP value of the solvent coincide with each other, the resin concerned is dissolved in solvents having various SP values, and the intrinsic viscosity is measured for each solvent, thereby estimating the SP value of the resin from the solubility parameter value of the solvent that gives the largest intrinsic viscosity value (H. Ahmed, M. Yassen, J. Coat. Technol., 50, 86 (1970), W. R. Song, D. W. Brownawell, Polym. Eng. Sci., 10, 222 (1970)); and (4) Method in which the SP value of a resin is obtained from the molecular attraction constant, i.e., a method in which the SP value is obtained from the molecular attraction constant (G) of each functional group or atom group constituting a resin molecule and the molecular volume (V) according to the equation of SP value= $\Sigma G/V$ (D. A. Small, J. Appl. Chem., 3, 71 (1953), K. L. Hoy, J. Paint Technol., 42, 76 (1970)).

In the following description of the present invention, a value that is obtained from the molecular attraction constant is used as an SP value of the resin, and the SP value of each solvent is shown by using a value that is obtained in view of the attraction force between molecules on the basis of Hildebrand-Scatchard's theory of solution (J. H. Hildebrand, R. L. Scott, "The Solubility of Nonelectrolytes" 3rd Ed., Reinhold Publishing cop., New York (1949), G. Scatchard, Chem. Rev., 8, 321 (1931). The SP value of the solvent is expressed by $$\text{SP value } (\delta)=(\Delta Ev/\Delta V_1)^{1/2}$$

wherein $\Delta Ev$: vaporization energy; $V_1$: molecular volume; and $\Delta Ev/\Delta V_1$: cohesive energy.

In the present invention, the SP value at 25° C. which is described in K. L. Hoy, J. Paint Technol., 42, 76 (1970), is used.

The relationship between the SP values of a resin and a solvent will be explained below by way of an example in which a resin is to be dissolved in a solvent. Polystyrene, which has an SP value of 9.1, is very soluble in tetrahydrofuran, which has an SP value of 9.1, and soluble in solvents having an SP value in a range of from 8.5 to 9.3. However, polystyrene is insoluble in n-hexane, which has an SP value of 7.3. Thus, the condition of a resin in a solvent can be presumed from the difference between the SP values of the resin and the solvent.

Incidentally, resin particles can be precipitated by a process in which, after a resin has been dissolved in a good solvent so that a relatively dilute solution is obtained, the solution is added to a poor solvent, and then the good solvent is removed. It may be considered that, in the good solvent, the resin is present in monomolecular form with the molecular chain expanded, but in the poor solvent, the molecular chain contracts, and resin particles are precipitated. Accordingly, the condition of the resin particles in the solvent differs according to whether the poor solvent used is a solvent which has such an SP value difference that the resin swells therein, or a solvent which has an SP value difference to so large extent that the resin is completely insoluble therein. In general, as the weight-average molecular weight of a resin increases, the diameter of resin particles formed increases.

(Copolymer Resin)

A copolymer resin is used in order to improve dispersibility of the foaming inhibitor such as trimellitic anhydride. Examples of copolymer resins usable in the liquid toner are thermoplastic resins such as styrene-butadiene copolymer resin, styrene-isoprene copolymer resin, styrene-acrylonitrile copolymer resin, ethylene-vinyl acetate copolymer resin, ethylene-acrylate copolymer resin, ethylene-acrylic acid copolymer resin, ethylene-methyl acrylate copolymer resin, ethylene-ethyl acrylate copolymer resin, vinyl acetate-methyl methacrylate copolymer resin, acrylic acid-methyl methacrylate copolymer resin, vinyl chloride-vinyl acetate copolymer resin, or the like. It is preferable to use a thermoplastic resin which has a melt flow rate (MFR) defined by ASTM D-1238 in a range of from 1 dg/min to 400 dg/min, more preferably from 2 dg/min to 150 dg/min. That MFR value range is equivalent to a range of from about 60,000 to about 250,000, and from about 75,000 to about 200,000 respectively, in terms of weight-average molecular weight.

The copolymer resin used in the present invention is composed of at least two different monomer components (polymeric units), which include a first monomer component which has a poor affinity to the electrically insulating dispersion medium to be regard as forming a portion insoluble in the dispersion medium and a second monomer component which has a good affinity to the electrically insulating dispersion medium to be regard as forming a portion soluble or swellable in the dispersion medium. The ratio of the second monomer component to the first monomer component (second/first) is preferably set in a range of from 95/5 to 5/95, more preferably from 85/15 to 15/85, by weight.

As the first monomer component, there may be exemplified polymeric units derived from the following monomers: (metha)acrylic acid, i.e., acrylic acid and methacrylic acid; (metha)acrylic ester having a small methylene such as methyl (metha)acrylate, ethyl (metha)acrylate, butyl (metha) acrylate; (metha)acrylic ester containing nitrogen such as dimethylaminoethyl (metha)acrylate or diethylaminoethyl (metha)acrylate; acrylic amide derivatives such as acrylic amide, isopropyl acrylic amide, methylene bisacrylic amide, N-allyl acrylic amide, N-diaceton acrylic amide or N,N-dimethyl acrylic amide; another monomer such as 2-hydroxyethyl (metha)acrylate, benzil (metha)acrylate, cyclohexyl (metha)acrylate, styrene, methyl styrene or vinyl acetate. Of these monomer components, polymeric units derived from methyl (metha)acrylate, ethyl (metha)acrylate, cyclohexyl (metha)acrylate methyl styrene and vinyl acetate are preferable as the first monomer component.

As the second monomer component effective in controlling solubility and dispersibility of the copolymer in the solvent, there may be exemplified polymeric units derived from vinyl monomer having a large methylene as a side chain. More specifically, the vinyl monomers include: (metha)acrylate having a large methylene such as 2-ethylhexyl (metha)acrylate, lauryl (metha)acrylate or stearyl (metha)acrylate; ethylene; isoprene; butadiene; and propylene. Of these monomer components, polymeric units derived from 2-ethylhexyl (metha)acrylate and ethylene are preferable as the second monomer component.

In the case of copolymer resin composed of three or more monomer components, it is preferable to define a component giving the largest difference of SP value in relation to the SP value of the dispersion medium as the first monomer component, while define a component giving the smallest difference of SP value in relation to the SP value of the dispersion medium as the second monomer component. The ratio between the two components should be set in the same way as in the case of a copolymer resin composed of two components as described above. If the third component gives an SP value similar to that of either component forming a insoluble portion as the first component or a soluble portion as the second component in relation to the SP value of the dispersion medium, the third component may be regarded as being equivalent to that component.

(Foaming Inhibitor)

A foaming inhibitor to be contained in the copolymer resin particles is required, as described above, to properly inhibit or suppress foaming ability of the foamable resin composition.

In the present invention, there is usually used powder of the foaming inhibitor having a mean particle size in a range of from 0.1 to 100 $\mu$m in the state of secondary aggregation. The foaming inhibitor can be contained in the copolymer resin particles in an amount of up to 80% by weight, preferably not more than 75% by weight. In the liquid toner of the present invention, the content of the copolymer resin particles can be increased without causing problems such as macro aggregation in contrast with the conventional liquid toners, as described above. Therefore, the foaming inhibitor content can be markedly increased.

(Additive)

Any additive such as a dispersant, a charge control agent, a fixing agent or the like may be added to the liquid toner of the present invention as required. Since the copolymer resin used in the present invention per se has an excellent affinity for the dispersion medium, it is not always necessary to add a dispersant to the liquid toner. However, if the granulation step (described later) is carried out in the presence of a dispersant, the dispersibility in the good solvent can be improved, and entanglement of molecular chains can be effectively controlled during granulation. Therefore, it is possible to reduce the toner particle size to an extent of the order of submicrons, and also possible to narrow the particle size distribution.

Polymer dispersants, e.g. polyhydroxycarboxylic acid esters, can be used as a dispersant in the present invention. Polyhydroxycarboxylic acid esters are polymers of ester derivatives of a hydroxycarboxylic acid. The hydroxycarboxylic acid is represented by the following formula:

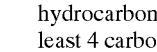

HO—X—COOH wherein, X is a bivalent saturated or unsaturated aliphatic hydrocarbon containing at least 12 carbon atoms. Further, at least 4 carbon atoms are present between the hydroxyl group and the carboxyl group.

As preferable examples of such ester derivatives of hydroxycarboxylic acid, there may be exemplified: alkyl esters of hydroxycarboxylic acid such as 12-hydroxystearic acid methyl ester, 12-hydroxystearic acid ethyl ester or the like; metal salts of hydroxycarboxylic acid such as 12-lithium hydroxycarboxylate, 12-aluminum hydroxycarboxylate or the like; hydroxycarboxylic acid amide; and hardened castor oil.

Polyhydroxycarboxylic acid esters is obtained by polymerization in which a hydroxycarboxylic acid ester is partially saponified in the presence of a small amount of an amine or a catalyst. Polyhydroxycarboxylic acid esters include various forms: one which is made up by esterification between respective molecules; and another which is made up by esterification in each of molecules.

Preferable polyhydroxycarboxylic acid esters are condensation products of from three to ten hydroxycarboxylic acid ester molecules, which are light gray-brown and wax-like substances. With a polymerization degree of polyhydroxycarboxylic acid ester smaller than 3 or larger 10, it is not compatible with a dispersion medium such as n-hexane to provide no effect as is expected from a dispersant. There is no specific restriction on the amount of polyhydroxycarboxylic acid ester to be added to the liquid toner of the present invention. However, the polyhydroxycarboxylic acid ester is usually used in an amount of from 0.01% to 200% by weight to the weight of the resin. The polyhydroxycarboxylic acid ester may be added in any production step before the granulation step.

The charge control agent may be added in the liquid toner to control charge polarity or charge quantity of the copolymer resin particles. Preferable examples of charge control agents usable in the present invention are: metal salts of dialkylsulfosuccinic acid such as dialkylcobalt sulfosuccinate, dialkylmanganese sulfosuccinate, dialkylzirconium sulfosuccinate, dialkylyttrium sulfosuccinate, dialkylnickel sulfosuccinate or the like; metallic soaps such as manganese naphthenate, calcium naphthenate, zirconium naphthenate, cobalt naphthenate, iron naphthenate, lead naphthenate, nickel naphthenate, chromium naphthenate, zinc naphthenate, magnesium naphthenate, manganese octylate, calcium octylate, zirconium octylate, iron octylate, lead octylate, cobalt octylate, chromium octylate, zinc octylate, magnesium octylate, manganese dodecylate, calcium dodecylate, zirconium dodecylate, iron dodecylate, lead dodecylate, cobalt dodecylate, chromium dodecylate, zinc dodecylate, magnesium dodecylate or the like; metal salts of alkylbenzenesulfonic acid such as calcium dodecylbenzenesulfonate, sodium dodecylbenzenesulfonate, barium dodecylbenzenesulfonate or the like; phospholipids such as lecithin, cephalin or the like; and organic amines such as n-decyl amine or the like.

It is important to control charge polarity of the copolymer resin particles by the charge control agent. For example, copolymer resin particles having a positive charge can be produced by using a copolymer composed of a basic monomer component as the first component, such as diethylaminoethyl (metha)acrylate, and the second monomer component such as 2-ethylhexyl (metha)acrylate in combination with the metallic soap such as zirconium naphthenate.

Besides, copolymer resin particles having a negative charge can be produced by using a copolymer composed of an acidic monomer component as the first component, such as (metha)acrylic acid, 2-hydroxyethyl (metha)acrylate, vinyl acetate or the like, and the second monomer component such as 2-ethylhexyl (metha)acrylate in combination with the charge control agent such as lecithin.

It is only necessary to add the minimum required amount of such a charge control agent to produce the charge control effect. In general, the charge control agent is added in the liquid toner in a range of from 0.01% to 50% by weight. The charge control agent may be added at any stage including the course of the production process (described later) and time after the removal of the solvent, and the desired charge control effect can be manifested in any case. It is, however, preferable to add the charge control agent during the production process before the granulation step.

As a fixing agent, various kinds of resin which are soluble in a dispersion medium, e.g. n-hexane, may be added. Examples of fixing agents usable in the present invention are modified or unmodified alkyd resins, ordinary acrylic resins, synthetic rubbers, polyalkylene oxides, polyvinyl acetals (including polyvinyl butyral), vinyl acetate resins or the like.

(Solvent)

Difference between SP values of solvent which can dissolve or swell the copolymer, i.e., good solvent and the electrically insulating dispersion medium may be taken to granulate the copolymer resin particles. The solvent is not always required to completely dissolve the copolymer, but it has to, at the room temperature(25° C.), dissolve or swell the copolymer, and otherwise disperse or disentangle a portion of homopolymer chain contained in the copolymer even if the copolymer is in insoluble state. Further, it is necessary that the solvent shows insolubility or difficulty in solubility against the foaming inhibitor which is to compose a core portion of the copolymer resin particles.

For the purpose of giving a good solubility to the copolymer resin, it is necessary that the SP value of the solvent is similar to either SP value of a SP value ($\delta p^1$) concerned in the first monomer component and a SP value ($\delta p^2$) concerned in the second monomer component. That is, the SP value ($\delta p^1$) is that of the homopolymer composed only of the first monomer component in the molecule of the copolymer resin, and the SP value ($\delta p^2$) is that of the homopolymer composed only of the second monomer component in the same. Further, it is preferable that the SP value of the solvent is similar to both of the SP values $\delta p^1$ and $\delta p^2$. In the case of styrene-isoprene copolymer resin, for example, the SP value of polystyrene (the first monomer component) is 9.1, and the SP value of polyisoprene (the second monomer component) is 8.15. Therefore, it can be dissolved in a solvent, e.g., toluene (SP value: 8.9) and cyclohexane (SP value: 8.2).

The following are examples of solvents (SP value) usable in the present invention: Cyclohexane (8.2), cellosolve acetate (9.4), toluene (8.9), tetrahydrofuran (9.1), methyl ethyl ketone (9.5), cyclohexanone (10.4), acetone (9.6), dioxane (10.1), ethyl cellosolve (10.7), cyclohexanol (11.4), methyl cellosolve (11.7), isopropyl alcohol (11.4), ethanol (12.8), and methanol (14.5).

When trimellitic anhydride is used as the foaming inhibitor, there may be used toluene, octyl alcohol, xylene, and 2-ethylhexanol as the solvent. Of these solvents, toluene is preferable.

(Electrically Insulating Dispersion Medium)

In the present invention, there is usually used an electrically insulating dispersion medium having a volume resistivity of not lower than $10^{10}$ Ω·cm. It is preferable for the present invention that the dispersion medium has the following features in SP value:

(i) a difference $\Delta(\delta p^1-\delta d)$ between a SP value ($\delta p^1$ ) of a homopolymer composed only of the first monomer component which is a part of the molecule of the copolymer resin and a SP value ($\delta d$) of the electrically insulating dispersion medium is not smaller than 1.0;

(ii) a difference $\Delta(\delta p^2-\delta d)$ between a SP value ($\delta p^2$ ) of a homopolymer composed only of the second monomer component which also is a part of the molecule of the copolymer resin and a solubility parameter value ($\delta d$) of the electrically insulating dispersion medium is not larger than 1.0; and (iii) a difference $\Delta(\delta p^1-\delta p^2)$ between the two solubility parameter values $\delta p^1$ and $\delta p^2$ of those homopolymers is at least 0.5.

For example, particles composed of styrene-isoprene copolymer resin and containing the foaming inhibitor can be precipitated by mixing a solution of styrene-isoprene copolymer resin with n-hexane in the presence of the foaming inhibitor. In this case, since the SP value ($\delta p^1$) of polystyrene is 9.1, and the SP value ($\delta p^2$) of polyisoprene is 8.15, and the SP value ($\delta d$) of n-hexane is 7.3, this case is according to the above described relationship as showed in the following calculation:

$$\delta p^1-\delta d=9.1-7.3=1.8,\ \therefore \Delta(\delta p^1-d)\geqq 1$$

$$\delta p^2-\delta d=8.15-7.3=0.85,\ \therefore \Delta(\delta p^2-\delta d)\leqq 1$$

$$\delta p^1-\delta p^2=9.1-8.15=0.95,\ \therefore \Delta(\delta p^1-\delta p^2)\geqq 0.5$$

Further, it may be considered that the styrene-isoprene copolymer resin particles have such a configuration in n-hexane as the dispersion medium that a portion which is derived from the isoprene component forms an outer skin portion in a soluble or swellable state, and a portion which is derived from the styrene component is adsorbed on or adheres to particles of the foaming inhibitor to form an insoluble core portion including the styrene component and the foaming inhibitor.

The following are homopolymers and their SP values, which are usable as indices when the SP values of homopolymers composed only of the first or second monomer component is defined: Polyethylene (8.1); polybutadiene (8.4); polyisoprene (8.15); polyisobutylene (7.7); polylauryl methacrylate (8.2); polystearyl methacrylate (8.2); polyisobornyl methacrylate (8.2); poly-t-butyl methacrylate (8.2); polystyrene (9.1); polyethyl methacrylate (9.1); polymethyl methacrylate (9.3); polymethyl acrylate (9.7); polyethyl acrylate (9.2); and polyacrylonitrile (12.8).

Examples of usable electrically insulating dispersion mediums and their SP values are as follows: n-hexane (7.3); n-heptane (7.5); n-octane (7.5); nonane (7.6); decane (7.7); dodecane (7.9); cyclohexane (8.2); perchloroethylene (9.3); and trichloroethane (9.9). It is also possible to use, as the dispersion medium, electrically insulating solvents available as a product name "Isopar" series from Exon Corporation, which have SP value in a range of from 7.0 to 7.3, and more specifically they include Isopar G, Isopar H, Isopar L, Isopar C, Isopar E, and Isopar M.

Examples of preferable combinations of a copolymer resin and a dispersion medium will be shown below.

First, preferable copolymer resins when n-hexane ($\delta d$= 7.3) is used as a dispersion medium will be shown below, together with the difference $\Delta(\delta p^1-\delta d)$ between the SP value ($\delta p^1$) of a homopolymer composed only of the first monomer component in each copolymer resin and the SP value ($\delta d$) of the dispersion medium, the difference $\Delta(\delta p^2-\delta d)$ between the SP value ($\delta p^2$) of a homopolymer composed only of the second monomer component in each copolymer resin and the SP value ($\delta d$) of the dispersion medium, and the difference $\Delta(\delta p^1-\delta p^2)$ between $\delta p^1$ and $\delta p^2$. It should be noted that the numerical value in each pair of parentheses shows the SP value of a homopolymer consisting only of the monomer component concerned.

Ethylene (8.1)–vinyl acetate (9.4) copolymer resin:

$\Delta(\delta p^1-\delta d)=2.1$; $\Delta(\delta p^2-\delta d)=0.8$; and $\Delta(\delta p^1-\delta p^2)=1.3$ Ethylene (8.1)–methyl acrylate (9.7) copolymer resin:

$\Delta(\delta p^1-\delta d)=2.4$; $\Delta(\delta p^2-\delta d)=0.8$; and $\Delta(\delta p^1-\delta p^2)=1.6$ Ethylene (8.1)–ethyl acrylate (9.2) copolymer resin:

$\Delta(\delta p^1-\delta d)=1.9$; $\Delta(\delta p^2-\delta d)=0.8$; and $\Delta(\delta p^1-\delta p^2)=1.1$ Styrene (9.1)–isoprene (8.15) copolymer resin:

$\Delta(\delta p^1-\delta d)=1.8$; $\Delta(\delta p^2-\delta d)=0.9$; and $\Delta(\delta p^1-\delta p^2)=0.9$ Lauryl methacrylate (8.2)–methyl methacrylate (9.3) copolymer resin:

$\Delta(\delta p^1-\delta d)=2.0$; $\Delta(\delta p^{2-\delta d)}=0.9$; and $\Delta(\delta p^1-\delta p^2)=1.1$ Lauryl methacrylate (8.2)–ethyl methacrylate (9.1) copolymer resin:

$\Delta(\delta p^1-\delta d)=1.8$; $\Delta(\delta p^2-\delta d)=0.9$; and $\Delta(\delta p^1-\delta p^2)=0.9$ Lauryl methacrylate (8.2)–methyl acrylate (9.7) copolymer resin:

$\Delta(\delta p^1-\delta d)=2.4$; $\Delta(\delta p^2-\delta d)=0.9$; and $\Delta(\delta p^1-\delta p^2)=1.5$ Lauryl methacrylate (8.2)–ethyl acrylate (9.2) copolymer resin:

$\Delta(\delta p^1-\delta d)=1.9$; $\Delta(\delta p^2-\delta d)=0.9$; and $\Delta(\delta p^1-\delta p^2)=1.0$ Lauryl methacrylate (8.2)–propyl acrylate (9.0) copolymer resin:

$\Delta(\delta p^1-\delta d)=1.7$; $\Delta(\delta p^2-\delta d)=0.9$; and $\Delta(\delta p^1-\delta p^2)=0.8$ Stearyl methacrylate (8.2)–methyl methacrylate (9.3) copolymer resin:

$\Delta(\delta p^1-\delta d)=2.0$; $\Delta(\delta p^2-\delta d)=0.9$; and $\Delta(\delta p^1-\delta p^2)=1.1$ Stearyl methacrylate (8.2)–ethyl methacrylate (9.1) copolymer resin:

$\Delta(\delta p^1-\delta d)=1.8$; $\Delta(\delta p^2-\delta d)=0.9$; and $\Delta(\delta p^1-\delta p^2)=0.9$ Stearyl methacrylate (8.2)–methyl acrylate (9.7) copolymer resin:

$\Delta(\delta p^1-\delta d)=2.4$; $\Delta(\delta p^2-\delta d)=0.9$; and $\Delta(\delta p^1-\delta p^2)=1.5$ Stearyl methacrylate (8.2)–ethyl acrylate (9.2) copolymer resin:

$\Delta(\delta p^1-\delta d)=1.9$; $\Delta(\delta p^2-\delta d)=0.9$; and $\Delta(\delta p^1-\delta p^2)=1.0$ Stearyl methacrylate (8.2)–propyl acrylate (9.0) copolymer resin:

$\Delta(\delta p^1-\delta d)=1.7$; $\Delta(\delta p^2-\delta d)=0.9$; and $\Delta(\delta p^1-\delta p^2)=0.8$ Isobornyl methacrylate (8.2)–methyl methacrylate (9.3) copolymer resin:

$\Delta(\delta p^1-\delta d)=2.0$; $\Delta(\delta p^2-\delta d)=0.9$; and $\Delta(\delta p^1-\delta p^2)=1.1$ Isobornyl methacrylate (8.2)–ethyl methacrylate (9.1) copolymer resin:

$\Delta(\delta p^1-\delta d)=1.8$; $\Delta(\delta p^2-\delta d)=0.9$; and $\Delta(\delta p^1-\delta p^2)=0.9$ Isobornyl methacrylate (8.2)–methyl acrylate (9.7) copolymer resin:

$\Delta(\delta p^1-\delta d)=2.4$; $\Delta(\delta p^2-\delta d)=0.9$; and $\Delta(\delta p^1-\delta p^2)=1.5$ Isobornyl methacrylate (8.2)–ethyl acrylate (9.2) copolymer resin:

$\Delta(\delta p^1-\delta d)=1.9$; $\Delta(\delta p^2-\delta d)=0.9$; and $\Delta(\delta p^1-\delta p^2)=1.0$ Isobornyl methacrylate (8.2)–propyl acrylate (9.0) copolymer resin:

$\Delta(\delta p^1-\delta d)=1.7$; $\Delta(\delta p^2-\delta d)=0.9$; and $\Delta(\delta p^1-\delta p^2)=0.8$ t-butyl methacrylate (8.3)–methyl methacrylate (9.3) copolymer resin:

$\Delta(\delta p^1-\delta d)=2.0$; $\Delta(\delta p^2-\delta d)=1.0$; and $\Delta(\delta p^1-\delta p^2)=1.0$ t-butyl methacrylate (8.3)–ethyl methacrylate (9.1) copolymer resin:

$\Delta(\delta p^1-\delta d)=1.8$; $\Delta(\delta p^2-\delta d)=1.0$; and $\Delta(\delta p^1-\delta p^2)=0.8$ t-butyl methacrylate (8.3)–methyl acrylate (9.7) copolymer resin:

$\Delta(\delta p^1-\delta d)=2.4$; $\Delta(\delta p^2-\delta d)=1.0$; and $\Delta(\delta p^1-\delta p^2)=1.4$ t-butyl methacrylate (8.3)–ethyl acrylate (9.2) copolymer resin:

$\Delta(\delta p^1-\delta d)=1.9$; $\Delta(\delta p^2-\delta d)=1.0$; and $\Delta(\delta p^1-\delta p^2)=0.9$ t-butyl methacrylate (8.3)–propyl acrylate (9.0) copolymer resin:

$\Delta(\delta p^1-\delta d)=1.7$; $\Delta(\delta p^2-\delta d)=1.0$; and $\Delta(\delta p^1-\delta p^2)=0.7$ Above-mentioned copolymer resins are usable in combination with n-heptane, n-octane, nonane, decane, dodecane, cyclohexane or the like in the same way as in the case of n-hexane.

The following are preferable examples of copolymer resins when perchloroethylene ($\delta d=9.3$) is used as a dispersion medium:

Ethylene (8.1)–vinyl acetate (9.4) copolymer resin:

$\Delta(\delta p^1-\delta d)=1.2$; $\Delta(\delta p^2-\delta d)=0.1$; and $\Delta(\delta p^1-\delta p^2)=1.3$ Ethylene (8.1)–methyl acrylate (9.7) copolymer resin:

$\Delta(\delta p^1-\delta d)=1.2$; $\Delta(\delta p^2-\delta d)=0.4$; and $\Delta(\delta p^1-\delta p^2)=1.6$ Ethylene (8.1)–ethyl acrylate (9.2) copolymer resin:

$\Delta(\delta p^1-\delta d)=1.2$; $\Delta(\delta p^2-\delta d)=0.1$; and $\Delta(\delta p^1-\delta p^2)=1.1$ Styrene (9.1)–isoprene (8.15) copolymer resin:

$\Delta(\delta p^1-\delta d)=1.15$; $\Delta(\delta p^2-\delta d)=0.2$; and $\Delta(\delta p^1-\delta p^2)=0.95$ Lauryl methacrylate (8.2)–methyl methacrylate (9.3) copolymer resin:

$\Delta(\delta p^1-\delta d)=1.1$; $\Delta(\delta p^2-\delta d)=0$; and $\Delta(\delta p^1-\delta p^2)=1.1$ Lauryl methacrylate (8.2)–ethyl methacrylate (9.1) copolymer resin:

$\Delta(\delta p^1-\delta d)=1.1$; $\Delta(\delta p^2-\delta d)=0.2$; and $\Delta(\delta p^1-\delta p^2)=0.9$ Lauryl methacrylate (8.2)–methyl acrylate (9.7) copolymer resin:

$\Delta(\delta p^1-\delta d)=1.1$; $\Delta(\delta p^2-\delta d)=0.4$; and $\Delta(\delta p^1-\delta p^2)=1.5$ Lauryl methacrylate (8.2)–ethyl acrylate (9.2) copolymer resin:

$\Delta(\delta p^1-\delta d)=1.1$; $\Delta(\delta p^2-\delta d)=0.1$; and $\Delta(\delta p^1-\delta p^2)=1.0$ Lauryl methacrylate (8.2)–propyl acrylate (9.0) copolymer resin:

$\Delta(\delta p^1-\delta d)=1.1$; $\Delta(\delta p^2-\delta d)=0.3$; and $\Delta(\delta p^1-\delta p^2)=0.8$ Stearyl methacrylate (8.2)–methyl methacrylate (9.3) copolymer resin:

$\Delta(\delta p^1-\delta d)=1.1$; $\Delta(\delta p^2-\delta d)=0$; and $\Delta(\delta p^1-\delta p^2)=1.1$ Stearyl methacrylate (8.2)–ethyl methacrylate (9.1) copolymer resin:

$\Delta(\delta p^1-\delta d)=1.1$; $\Delta(\delta p^2-\delta d)=0.2$; and $\Delta(\delta p^1-\delta p^2)=0.9$ Stearyl methacrylate (8.2)–methyl acrylate (9.7) copolymer resin:

$\Delta(\delta p^1-\delta d)=1.1$; $\Delta(\delta p^2-\delta d)=0.4$; and $\Delta(\delta p^1-\delta p^2)=1.5$ Stearyl methacrylate (8.2)–ethyl acrylate (9.2) copolymer resin:

$\Delta(\delta p^1-\delta d)=1.1$; $\Delta(\delta p^2-\delta d)=0.1$; and $\Delta(\delta p^1-\delta p^2)=1.0$ Stearyl methacrylate (8.2)–propyl acrylate (9.0) copolymer resin:

$\Delta(\delta p^1-\delta d)=1.1$; $\Delta(\delta p^2-\delta d)=0.3$; and $\Delta(\delta p^1-\delta p^2)=0.8$ Isobornyl methacrylate (8.2)–methyl methacrylate (9.3) copolymer resin:

$\Delta(\delta p^1-\delta d)=1.1$; $\Delta(\delta p^2-\delta d)=0$; and $\Delta(\delta p^1-\delta p^2)=1.1$ Isobornyl methacrylate (8.2)–ethyl methacrylate (9.1) copolymer resin:

$\Delta(\delta p^1-\delta d)=1.1$; $\Delta(\delta p^2-\delta d)=0.2$; and $\Delta(\delta p^1-\delta p^2)=0.9$ Isobornyl methacrylate (8.2)–methyl acrylate (9.7) copolymer resin:

$\Delta(\delta p^1-\delta d)=1.1$; $\Delta(\delta p^2-\delta d)=0.4$; and $\Delta(\delta p^1-\delta p^2)=1.5$ Isobornyl methacrylate (8.2)–ethyl acrylate (9.2) copolymer resin:

$\Delta(\delta p^1-\delta d)=1.1$; $\Delta(\delta p^2-\delta d)=0.1$; and $\Delta(\delta p^1-\delta p^2)=1.0$ Isobornyl methacrylate (8.2)–propyl acrylate (9.0) copolymer resin:

$\Delta(\delta p^1-\delta d)=1.1$; $\Delta(\delta p^2-\delta d)=0.3$; and $\Delta(\delta p^1-\delta p^2)=0.8$ t-butyl methacrylate (8.3)–methyl methacrylate (9.3) copolymer resin:

$\Delta(\delta p^1-\delta d)=1.0$; $\Delta(\delta p^2-\delta d)=0$; and $\Delta(\delta p^1-\delta p^2)=1.0$ t-butyl methacrylate (8.3)–ethyl methacrylate (9.1) copolymer resin:

$\Delta(\delta p^1-\delta d)=1.0$; $\Delta(\delta p^2-\delta d)=0.2$; and $\Delta(\delta p^1-\delta p^2)=0.8$ t-butyl methacrylate (8.3)–methyl acrylate (9.7) copolymer resin:

$\Delta(\delta p^1-\delta d)=1.0$; $\Delta(\delta p^2-\delta d)=0.4$; and $\Delta(\delta p^1-\delta p^2)=1.4$ t-butyl methacrylate (8.3)–ethyl acrylate (9.2) copolymer resin:

$\Delta(\delta p^1-\delta d)=1.0$; $\Delta(\delta p^2-\delta d)=0.1$; and $\Delta(\delta p^1-\delta p^2)=0.9$ t-butyl methacrylate (8.3)–propyl acrylate (9.0) copolymer resin:

$\Delta(\delta p^1-\delta d)=1.0$; $\Delta(\delta p^2-\delta d)=0.3$; and $\Delta(\delta p^1-\delta p^2)=0.7$ The following are preferable examples of copolymer resins when trichloroethane ($\delta d=9.9$) is used as a dispersion medium:

n-propyl methacrylate (8.8)–methyl acrylate (9.7) copolymer resin:

$\Delta(\delta p^1-\delta d)=1.1$; $\Delta(\delta p^2-\delta d)=0.2$; and $\Delta(\delta p^1-\delta p^2)=0.9$ n-propyl methacrylate (8.8)–methyl methacrylate (9.3) copolymer resin:

$\Delta(\delta p^1-\delta d)=1.1$; $\Delta(\delta p^2-\delta d)=0.6$; and $\Delta(\delta p^1-\delta p^2)=0.5$ n-butyl methacrylate (8.7)–methyl acrylate (9.7) copolymer resin:

$\Delta(\delta p^1-\delta d)=1.2$; $\Delta(\delta p^2-\delta d)=0.2$; and $\Delta(\delta p^1-\delta p^2)=1.0$ n-butyl methacrylate (8.7)–ethyl acrylate (9.2) copolymer resin:

$\Delta(\delta p^1-\delta d)=1.2$; $\Delta(\delta p^2-\delta d)=0.7$; and $\Delta(\delta p^1-\delta p^2)=0.5$ n-butyl methacrylate (8.7)–methyl methacrylate (9.3) copolymer resin:

$\Delta(\delta p^1-\delta d)=1.2$; $\Delta(\delta p^2-\delta d)=0.6$; and $\Delta(\delta p^1-\delta p^2)=0.6$ n-hexyl methacrylate (8.6)–methyl acrylate (9.7) copolymer resin:

$\Delta(\delta p^1-\delta d)=1.3$; $\Delta(\delta p^2-\delta d)=0.2$; and $\Delta(\delta p^1-\delta p^2)=1.1$ n-hexyl methacrylate (8.6)–ethyl acrylate (9.2) copolymer resin:

$\Delta(\delta p^1-\delta d)=1.3$; $\Delta(\delta p^2-\delta d)=0.7$; and $\Delta(\delta p^1-\delta p^2)=0.6$ n-hexyl methacrylate (8.6)–methyl methacrylate (9.3) copolymer resin:

$\Delta(\delta p^1-\delta d)=1.3$; $\Delta(\delta p^2-\delta d)=0.6$; and $\Delta(\delta p^1-\delta p^2)=0.7$ n-hexyl methacrylate (8.6)–ethyl methacrylate (9.1) copolymer resin:

$\Delta(\delta p^1-\delta d)=1.3$; $\Delta(\delta p^2-\delta d)=0.8$; and $\Delta(\delta p^1-\delta p^2)=0.5$ (Producing Method of Liquid Toner)

There are two way to produce the liquid toner, one of which takes difference between the SP values of the solvent and the electrically insulating dispersion medium, and the other does not take that difference.

Whether the producing method takes the difference between the SP values of the solvent and the electrically insulating dispersion medium or not, resin particles each having a configuration in which a surface of a fine particle of a foaming inhibitor is covered with a resin and also having capability to be dispersed in the electrically insulating dispersion medium are precipitated out from a liquid dissolving or dispersing the foaming inhibitor and the resin therein by taking change of solubility of the used resin.

When the difference of the SP values is not taken, powder or pellets of the copolymer resin per se or a varnish dissolving or dispersing the copolymer resin is mixed with the electrically insulating dispersion medium in the presence of the foaming inhibitor. The mixture of the above materials may be kneaded as required. Further, in order to sufficiently cover or wrap the fine particles of the foaming inhibitor with the copolymer resin, the powder or pellets of the copolymer resin may be dissolved first by properly heating and thereafter cooling. In order to make the foaming inhibitor coexist in the mixing step, powder of the foaming inhibitor may be added in the electrically insulating dispersion medium simultaneously with the copolymer resin or the varnish thereof, and otherwise, the powder of the foaming inhibitor may solely be added in the electrically insulating dispersion medium before mixing of the copolymer resin or the varnish thereof. After dispersing the foaming inhibitor in the electrically insulating dispersion medium, solvent of the varnish may be removed as required by means of an evaporator or the like. If the solvent of the varnish remaining in the liquid toner is not harmful to property or performance of the toner, the solvent is permitted not to be removed.

In the other example of the method which does not take the difference between the SP values of the solvent and the dispersion medium, the liquid toner is produced by: (1) providing the foaming inhibitor; (2) further providing a copolymer resin composed of at least two different monomer components including a first and a second monomer components; (3) still further providing the electrically insulating dispersion medium being related to the copolymer resin such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5; (4) adding the copolymer resin in the dispersion medium and dissolving it by heating, while adding the foaming agent in the dispersion medium at the same time or a different time and dispersing it to prepare a heated mixture containing the dissolved copolymer resin and the dispersed foaming agent; and then (5) cooling the heated mixture at a moderate rate.

On the other hand, when the difference of the SP values is taken, the liquid toner is produced by: (1) providing a solution prepared by dissolving or dispersing the copolymer resin composed of at least two different monomer components including a first and a second monomer components in the solvent; (2) further providing the electrically insulating dispersion medium being related to the copolymer resin such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5; (3) mixing the solution of the copolymer resin with the dispersion medium in the presence of the foaming inhibitor affecting a foamable resin composition with a condition keeping a dispersed state of the foaming inhibitor; and then (4) removing the solvent from the mixture after mixing of the dispersion medium.

The copolymer resin particles are precipitated (granulated) in the mixing step of the electrically insulating dispersion medium described as (3) and/or the removing step of the solvent described as (4).

First, in the step (1), the copolymer resin is dissolved in a proper solvent to prepare a solution. The resin solution may be prepared by mixing the varnish of the copolymer resin with the solvent. Though it is preferable that the copolymer resin is completely dissolved in the solution, the copolymer resin is allowed to be present in a swelled state in the solution nevertheless, and further allowed to be present even in an insoluble state as far as a portion of homopolymer chain incorporated in the copolymer resin is dispersed or disentangled in the solution. In view of that point, it is preferable to use a solvent which can, at the room temperature (25° C.), dissolve or swell the copolymer resin, or disperse or disentangle a portion of the homopolymer chain of the copolymer resin. Further, it is necessary that the solvent shows insolubility or difficulty in solubility against the foaming inhibitor.

In this method, it is preferable to use trimellitic anhydride and/or benzotriazole as the foaming inhibitor in combination with any one of solvents selected among toluene, xylene, octyl amine and 2-ethylhexanol.

If a dispersant is added to the copolymer resin solution in an amount in a range of from 0.3% to 0.5% by weight, a favorable resin dispersion condition can be obtained. The copolymer resin may be dissolved in the solvent in desired proportions. However, if the resin ratio is excessively high, resin particles come in contact with each other and are likely to gel in the granulation process. Therefore, it is preferable to dissolve the copolymer resin in an amount in a range of from 1% to 80%, more preferably from 5% to 10%, by weight, to thereby prepare a dilute solution.

Next, in the dispersion medium mixing step (3), the solution prepared in the step (1) is mixed with the electrically insulating dispersion medium provided in the step (2) in the presence of the foaming inhibitor such as trimellitic anhydride to precipitate the copolymer resin particles. The foaming inhibitor is kept in the dispersed state during this mixing step (3).

For example, when a solution of styrene-isoprene copolymer resin in toluene containing the styrene-isoprene copolymer resin at 10% by weight to an amount of the toluene is mixed with n-hexane, the mixture gets whitely turbid, thereby clearly observing precipitation of styrene-isoprene copolymer resin particles. If the above mentioned solution of styrene-isoprene copolymer resin is mixed with n-hexane in the presence of trimellitic anhydride as the foaming inhibitor, the dispersed trimellitic anhydride makes observation of the white turbidity difficult, but it is possible to observe that resin particles containing the trimellitic anhydride adhere to an inner wall of a glass bottle.

The foaming inhibitor such as trimellitic anhydride can be made to coexist in the mixing step by previously adding the powder of the foaming inhibitor to the copolymer resin solution or the electrically insulating dispersion medium. When the copolymer resin solution is mixed with the electrically insulating dispersion medium in the presence of the foaming inhibitor, a molecular chain of the copolymer which was soluble, swelled, or molecule-disentangled state in the solution is made placed in a dispersion medium serving as a poor solvent. As the result, the molecular chain of the copolymer resin adsorbs or adheres to a surface of the foaming inhibitor particle via the first monomer component having a larger affinity to the foaming inhibitor rather than to the dispersion medium, and gets entangled in each other so as to surround the foaming inhibitor particle, thereby forming the copolymer resin particles. A surface of the thus formed copolymer resin particle is rich with the second monomer component having a large affinity to the electrically insulating dispersion medium and constitutes a soluble or swellable portion of the copolymer resin particles in relation to the dispersion medium. Accordingly, even if the copolymer resin particles contain a large amount of the foaming inhibitor, particles of the foaming inhibitor are prevented from coming into contact with each other, thereby improving dispersion stability.

As described above, the charge control agent may be added, at any stage in the course of the production process, into some raw material such as the copolymer resin, the foaming inhibitor or the like or some substances other than the raw materials such as the solvent, the intermediate product present after granulation or solution-removing or the like. It is preferable to previously add the charge control agent in the copolymer resin solution or the electrically insulating dispersion medium so as to carry out the granulation in the both presence of the foaming inhibitor and the charge control agent.

Then, in the step (4), the good solvent is removed from the liquid mixture containing the copolymer resin particles, dispersion medium and the good solvent. From the viewpoint of granulation, it is preferable to remove the solvent by decantation, evaporation or the like. To adjust the resin particle diameter, the resin particles may be further finely divided by means of a ball mill, an attriter, a sand grinder, a Kady mill, a three-roll mill or the like.

The liquid toner in which the copolymer resin particles containing the foaming inhibitor are dispersed in the electrically insulating dispersion medium is produced by the above described methods. A core portion of the copolymer resin particle is composed mainly of the foaming inhibitor and the first monomer component of the copolymer adsorbing the surface of the foaming inhibitor, and that portion is insoluble to the dispersion medium, but an outer skin portion which is rich with the second monomer component having a large affinity to the electrically insulating dispersion medium is formed around the core portion. Accordingly, the copolymer resin particles are dispersed well in the liquid toner, and even if content of the particles is increased, the particles have an improved dispersion stability with no occurrence of gelation, macro aggregation, precipitation or the like. The content of copolymer resin particles in the liquid toner is usually in a range of from 0.01% to 80%, and preferably from 0.1% to 50%, by weight.

(3) Manufacturing Method of Foamed Product and Intermediate Product Thereof

In the present invention, a foamed product having a convexo-concave pattern can be manufactured by: (1) providing a foamable preform having a foamable portion made of a foamable resin composition; (2) further providing a recording material containing a foaming inhibitor which is usable for a printing method based on an on-demand system capable of outputting an image directly on an receiving material according to electric, thermal or optical record signals; (3) applying the recording material on the foamable preform by the printing method based on an on-demand system to make the recording material containing the foaming inhibitor adhere on or infiltrate into a surface of the foamable portion in a prescribed pattern; and then (4) foaming the foamable portion after the applying of the recording material to form the surface of the foamable portion into a convexo-concave pattern.

In the present invention, the on-demand type printing method means printing methods capable of foaming an image including many patterns such as patterns in the narrow sense, marks, symbols, pictures, photographs or the like directly on a print-receiving material with no use of the form plate, and examples of the on-demand type include an electrostatic record, an electrostatic image transfer, a thermal transfer, an ink-jet print or the like. The electrostatic record and the electrostatic image transfer are particularly fit for the present invention as described below.

As a matter of course, a designer, developer or producer engaged in the wall paper, the flooring material or another foamed products can adapt the following method to manufacturing a foamed product of a high quality design, a surface of which is not only formed into a convexo-concave surface pattern but also printed with a colored image. That is, such a foamed product as having a surface provided with freely designed convexo-concave pattern and printed color image can be manufactured by: (1) providing the recording material containing the foaming inhibitor which is usable for a recording method based on the on-demand system, such as the liquid toner described above; (2) further providing at least one recording material containing a coloring material which is also usable for the same or a different recording method based on the on-demand system; (3) carrying out the one or more recording methods each based on the on-demand system with the use of the recording material containing the foaming inhibitor and one or more of the recording materials each containing a coloring material to prepare a foamable intermediate product in which the foaming inhibitor and one or more coloring materials adhere on or infiltrated into a surface of the foamable intermediate product in the same or different patterns respectively; and then (4) foaming a foamable portion of the foamable intermediate product by heating or the like.

A process adaptable to preparing the foamable intermediate product having the printed color image as well as the pattern of the foaming inhibitor may associate a conventional printing method utilizing the form plate such as a gravure printing which is to be carried out for applying the recording material containing the coloring material with the on-demand type printing method which is to be carried out for applying the recording material containing the foaming inhibitor.

In one preferable method, the foamed product having a convexo-concave pattern of a quality design may be manufactured in such manner that the foaming inhibitor is made adhere on or infiltrate into a surface of a foamable preform, i.e., a preform capable of being foamed, in a prescribed pattern with the use of the above mentioned liquid toner, as the recording medium, through a image-forming system utilizing electrostatic effect such as an electrostatic record, an electrostatic image transfer, electrostatic print or the like, and thereafter the foamable preform is foamed.

Among these electrostatic image-forming systems, the liquid toner of the present invention is particularly fit for an on-demand type system such as the electrostatic record or the electrostatic image transfer, and the use of such a liquid toner can easily and quickly form the pattern of the foaming inhibitor without the form plate.

In the electrostatic recording process, an electrostatic latent image is directly made on the surface of the foamable preform, and then the foamable preform is exposed to the liquid toner to develop the latent image, thus forming a pattern containing the foaming inhibitor. On the other hand, in the electrostatic image transfer process, an electrostatic latent image is made on a surface of a dielectric support which is not the foamable preform, and the dielectric support is then exposed to the liquid toner to develop the latent image, and the thus formed pattern containing the foaming inhibitor is directly or indirectly transferred from the dielectric support to the surface of the foamable preform. In the electrostatic image transfer process, the toner pattern made on the dielectric support may directly be transferred on a surface of a transfer receiving material by an electrostatic force. Otherwise, the toner pattern on the dielectric support may indirectly be transferred on a surface of a receiving material in such manner that the toner pattern is temporarily transferred from the dielectric support to a surface of an intermediate receiving material by an electrostatic force, and then transferred again from the intermediate receiving material to the surface of the receiving material by a proper way such as thermal transferring.

Figure 2:
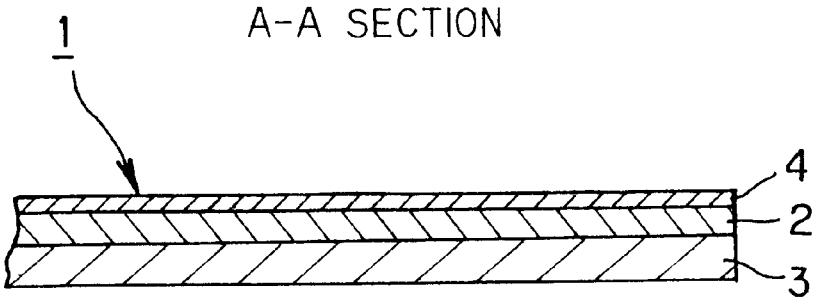
FIG. 2 is a sectional view schematically showing a A—A section of the foamable preform in FIG. 1.

FIGS. 1 to 7 show successive steps to manufacture a tile-like foamed product, i.e., a foamed product which has a surface appearance similar to the tile, by utilizing a technique of the electrostatic record. FIG. 1 is a partial plan view of one example (1) of the foamable preform usable for the present invention, and FIG. 2 is a sectional view schematically showing a cross section exposed by cutting off the foamable preform (1) along a A—A line indicated in FIG. 1. As shown in FIG. 2, the foamable preform (1) is constituted by forming a foamable portion 2 made of a foamable resin composition on one side of the support 3, and further forming a dielectric layer 4 on the foamable portion 2. The dielectric layer 4 is formed of a resin or resin composition excellent in electrification ability in order to provide an appropriate electrification ability to the surface of the foamable portion. When the foamable portion 2 is formed of a resin not so much in electrification ability such as polyvinyl chloride, it is difficult to make a good latent image unless providing the dielectric layer. If a resin having an excellent electrification ability is used as the foamable resin, the foamable preform may be constituted only of the portion made of the foamable resin provided with a conductive layer The resin composition for the formable portion and the support usable in the present invention may be formed out with the use of materials known in the conventional chemical emboss techniques. Examples of the support 3 include a paper, a cloth, a fabric, a looped fabric a felt, a nonwoven fabric or the like. The foamable portion 2 on the support may be formed out with the use of the foamable resin composition described herein before.

The dielectric layer 4 may be formed out with the use of materials known in the conventional electrostatic recording. Preferable examples of the material forming the dielectric layer 4 include: acrylic resin, styrene resin, polyester, polyolefine, polyamide, polyether, polyimide, polyamideimide, polyetherester, poly-p-phenylenesulfide, polyvinyl chloride, fluororesin, polycarbonate resin, or the like. When the foamable portion is formed of a resin composition mainly or essentially composed of polyvinyl chloride, it is preferable to form the dielectric layer 4 out of the following materials: acrylic resin; polyester; ethylene copolymers such as ethylene-vinyl acetate copolymer, ethylene-acrylic acid copolymer or ethylene-methacrylic acid copolymer; or the like. The above exemplified resins are excellent in adhesion property to polyvinyl chloride and heat resistance as well as electrification ability.

Figure 3:
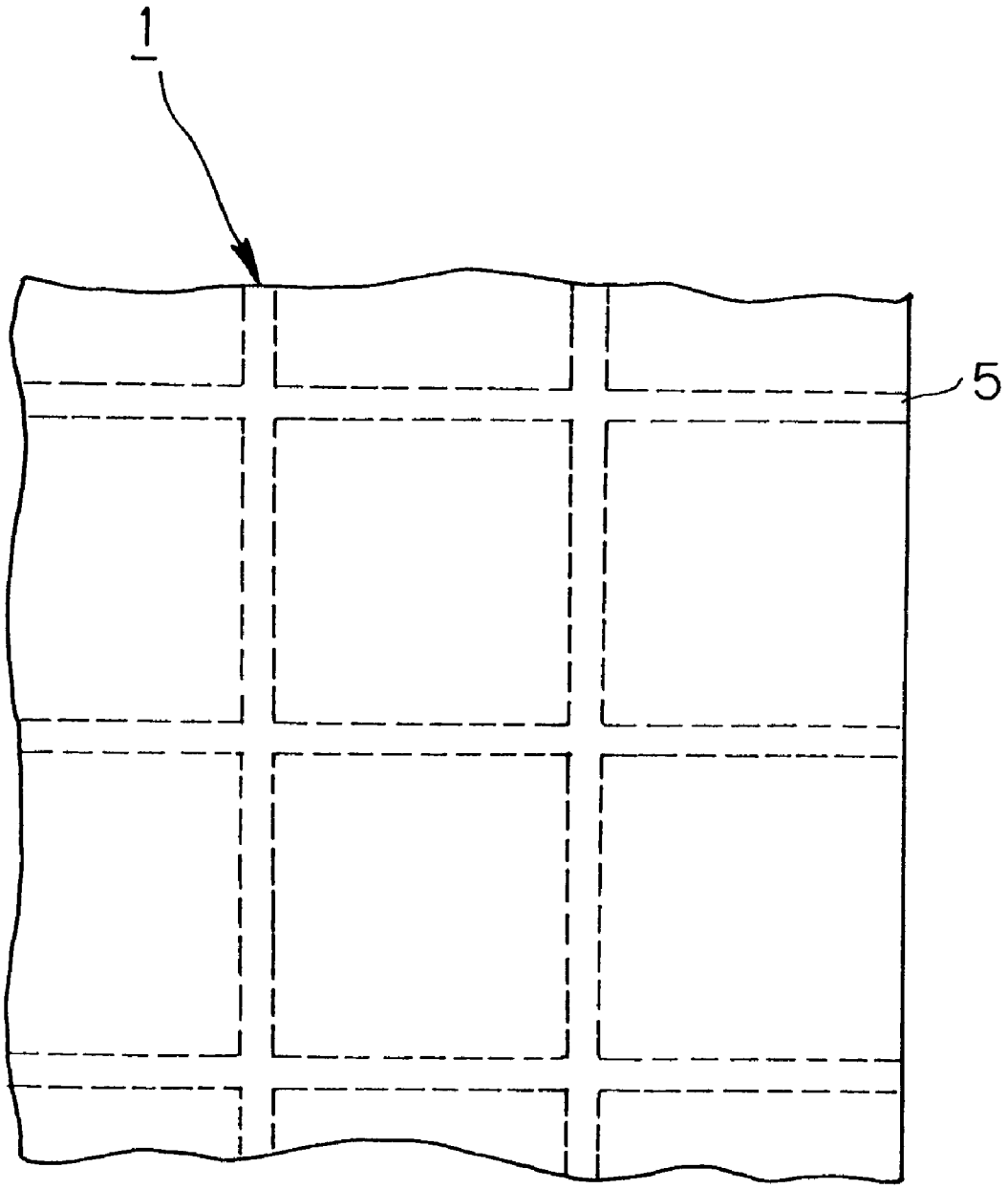
FIG. 3 is a partial plan view showing a state in which an electrostatic latent image is made on a surface of the foamable preform.

Such a foamable preform as mentioned above is previously provided, and then, as shown in FIG. 3, an electrostatic latent image 5 is made on the surface of the foamable portion 2 of the foamable preform 1. In FIG. 3, for the purpose of providing the tile-like pattern to the foamable preform, a position on the preform corresponding to the luted portion of the actual tile arrangement is intended to be formed into a concave portion which is not foamed, and therefore, the electrostatic latent image 5 is made so that the charged portion has a lattice pattern and the non charged portion has a square pattern.

Figure 4:
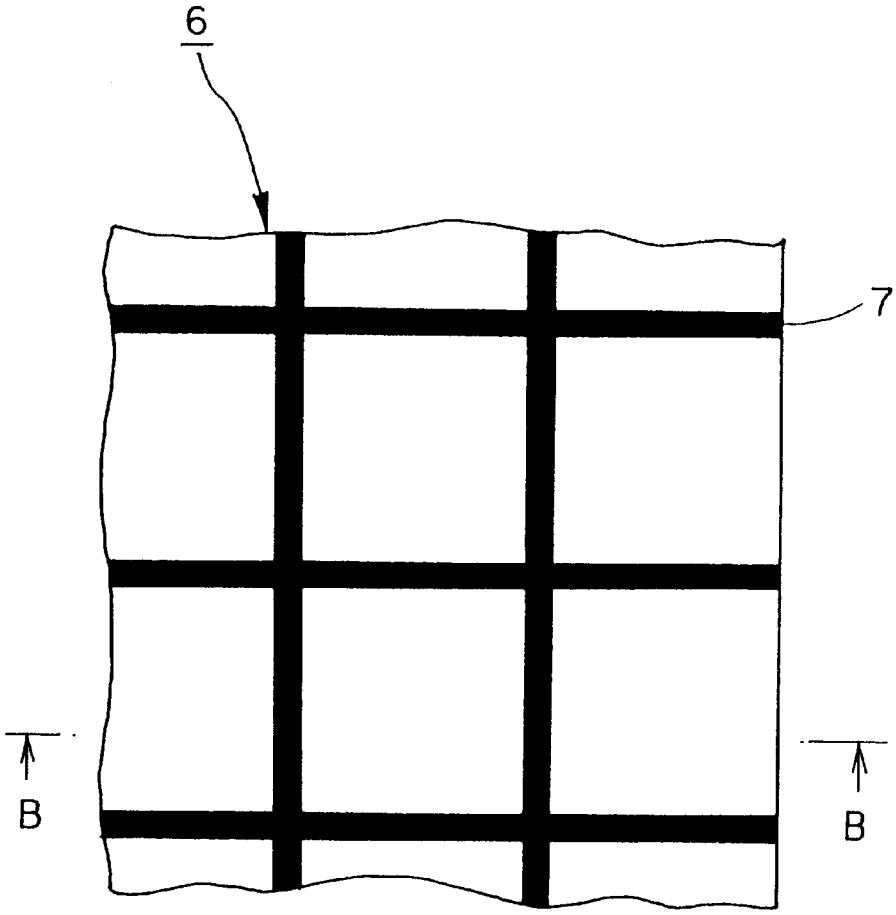
FIG. 4 is a partial plan view of a foamable intermediate product prepared by developing the electrostatic latent image on the surface of the foamable preform with the use of a liquid toner containing a foaming inhibitor.
Figure 5:
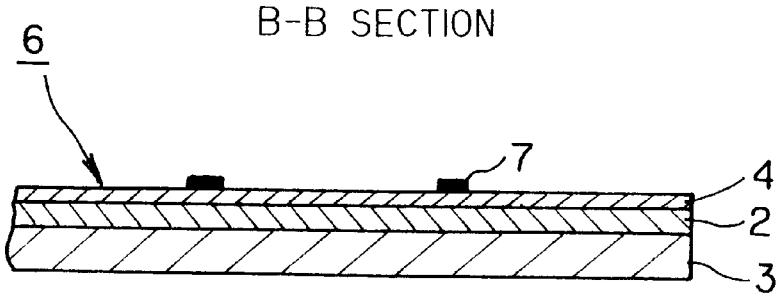
FIG. 5 is a sectional view schematically showing a B—B section of the foamable intermediate product in FIG. 4.

Next, the surface of the foamable portion 2 having the latent image 5 is exposed to the liquid toner of the present invention, and thereupon the copolymer resin particles which have been dispersed in the liquid toner adhere to the charged portion of the latent image 5. As the result, as shown in FIGS. 4 and 5, a coating 7 containing the foaming inhibitor is formed in the lattice pattern on the surface of the foamable portion 2, thus obtaining a foamable intermediate product 6 having the pattern of the foaming inhibitor.

Figure 6:
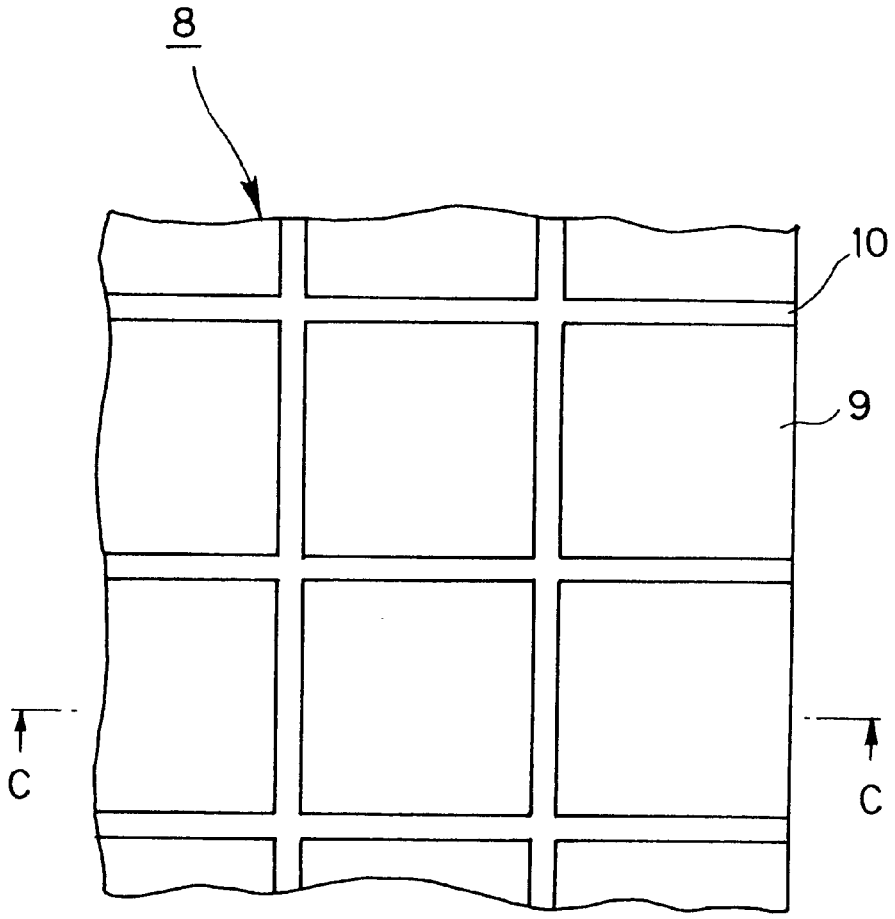
FIG. 6 is a partial plan view of one foamed product having a convexo-concave surface according to the present invention.
Figure 7:
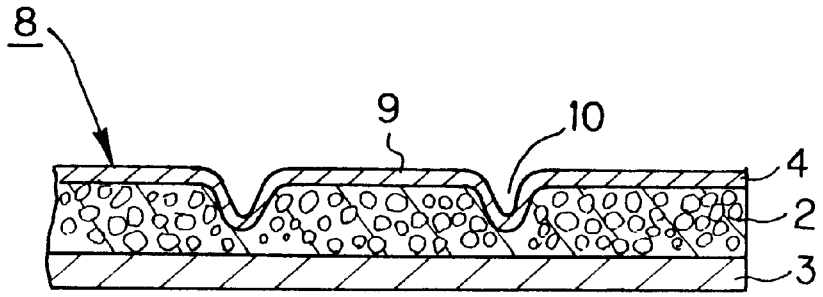
FIG. 7 is a sectional view schematically showing a C—C section of the foamed product having a convexo-concave surface in FIG. 6.

Thereafter, the foamable intermediate product 6 is heated at an appropriate temperature to obtain the tile-like foamed product 8 in which, as shown in FIGS. 6 and 7, the concave portion 10 which is not foamed is formed in the lattice pattern. When the foamable intermediate product 6 is heated, the foaming inhibitor which has been present on the surface of the foamable portion 2 is infiltrated into the foamable portion, and then a catalytic effect of the foaming accelerator is inhibited or suppressed at a portion right under the pattern of the foaming inhibitor, thereby raising up the foaming temperature of that portion. Therefore, it is possible to obtain the foamed product 8 provided with the convex portion 9 in which the volume is increased by foaming and the concave portion 10 which is left nonfoamed in accordance with the pattern of the foaming inhibitor or the electrostatic latent image, by heating the foamable intermediate product 6 at a temperature which reaches at least the minimum temperature to foam an area straying from the pattern of the foaming inhibitor while remains under the other minimum temperature to foam a portion right under the pattern of the foaming inhibitor.

As described above, the present invention provides the liquid toner stably dispersing the toner particles containing the foaming inhibitor. When the patterning technique utilizing electrostatic force such as the electrostatic record or the electrostatic image transfer is carried out with the use of the liquid toner of the present invention, the foaming inhibitor can be applied easily and quickly in a desired pattern on the surface of the foamable preform. Therefore, the foamed product having a convexo-concave surface and the intermediate product thereof can be obtained quickly at a low cost. In particular, the present invention can flexibly respond to requirements of, for example, trial manufacture in a developing stage, preparation of a sample for a presentation, sales of multi product in small quantity or the like.

EXAMPLE

Hereinafter, the liquid toner and the foamed product of the present invention are concretely described through experimental examples.

(Example 1)

(1) Production of Liquid Toner

A liquid toner 1 having the composition described below was produced. First, a master toner was prepared by mixing all the materials with each other except the dispersion medium for dilution, pouring the mixture into a mixing container together with glass beads for mixing, dispersing the mixture for three hours by means of a dispersing machine (RC-5000, manufactured by Red Devil Corporation), and then removing the glass beads. Further, 58 parts by weight of the thus prepared master toner was diluted with 662.0 parts by weight of Isoper (product name of Exon Corporation) for dilution to adjust a total weight to 720 g, thus obtaining the liquid toner 1. Copolymer resin particles in this liquid toner was charged as positive.

| <Composition of Liquid Toner 1> | |
|---|---|
| Varnish of 2-ehtylhexyl methacrylate (EHMA) - ethyl acrylate (EA) copolymer resin, wherein the first monomer component: EA ($\delta p^1 = 9.2$), the second monomer component: EHMA ($\delta p^2 = 7.7$), solid compoonent: 40% by weight, dispersion medium: Isoper G (product name of Exon Corporation), weight ratio: EHMA/EA = 70/30, weight average molecular weight: 150,000 | 10.0 parts by weight |
| Trimellitic anhydride as a foaming inhibitor (Mitsubishi Gas Kagaku Corporation) | 4.0 parts by weight |
| Zirconium naphthenate as a charge control agent (NIKKA NAPHTHECS Zr, available from Nihon Kagaku Sangyo Corporation) | 4.0 parts by weight |
| Dispersion for master toner (Isoper G, available from Exon) | 40.0 parts by weight |
| (Subtotal: | 58.0 parts by weight) |
| Dispersion for dilution (Isoper G, available from Exon) | 662.0 parts by weight |
| (Total: | 720.0 parts by weight) |

(2) Production of Dielectric Wall Paper

An asbestos paper having a thickness of 100 $\mu$m was used as a support, and a preform for wall paper was prepared by forming a foamable layer composed of a resin composition having the composition described below, in a thickness of 250 $\mu$m, on one side of the support. Further, a coating liquid having the composition described below was applied on the foamable layer by means of a Mayer bar so as to adjust an applied amount to 3 g/m$^2$ after dried to form a dielectric layer. Still further, a conductive layer was coated on the other surface of the asbestos paper support which is opposite to one provided with the foamable layer, thus obtaining an intermediate product for wall paper having dielectric ability and foaming ability.

| <Composition of Foamable Resin Composition> | |
|---|---|
| Polyvinyl chloride resin (G-121, available from Nihon Zeon Corporation) | 100 parts by weight |
| Dioctyl phosphate (DOP, available from Mitsubishi Kagaku Corporation) | 60 parts by weight |
| Azodicarbonamide (AZ-S, available from Ohtsuka Kagaku Corporation) | 2 parts by weight |
| Titan white (R-820, available from Ishihara Sangyo Corporation) | 10 parts by weight |
| <Composition of Coating Liquid for dielectric layer 1> | |
| Acrylic resin (BR-85, available from Mitsui-Dupont Corporation) | 10.0 parts by weight |
| Methyl ethyl Ketone | 90.0 parts by weight |

(3) Production of Wall Paper having Non-foamed Pattern

−6 KV of voltage was impressed on a surface of the prepared intermediate product for wall paper by means of a scorotron to make an electrostatic latent image of a binary pattern having a surface voltage of −200 V. Next, the latent image was developed in a vat with the use of the liquid toner 1 to form a pattern of the foaming inhibitor on a surface of the foamable layer, and then the foamable layer was foamed by heating at 200° C. for two minutes, thus obtaining a foamed wall paper having a convexo-concave surface.

(Example 2)

A foamed wall paper having a convexo-concave surface of the Example 2 was obtained in the same manner as that in the Example 1 except that the copolymer resin described below was used instead of the EHMA-EA copolymer resin. Content of the prepared liquid toner is shown in Table 1(1/2, 2/2).

<Copolymer Resin used in Example 2>

2-ethylhexyl methacrylate (EHMA)−methyl methacrylate (MMA) copolymer resin, wherein the first monomer component: MMA ($\delta p^1$=9.3), the second monomer component: EHMA ($\delta p^2$=7.7), weight ratio: EHMA/MMA=80/20

(Example 3)

A foamed wall paper having a convexo-concave surface of the Example 3 was obtained in the same manner as that in the Example 1 except that the weight ratio of the monomer components (EHMA/EA) was changed to 60/40. Content of the prepared liquid toner is shown in Table 1(1/2, 2/2).

(Example 4)

A foamed wall paper having a convexo-concave surface of the Example 4 was obtained in the same manner as that in the Example 1 except that benzotriazole (BTA-120) was used instead of the trimellitic anhydride. Content of the prepared liquid toner is shown in Table 1(1/2, 2/2).

(Comparison Example 1)

A liquid toner of the comparison Example 1 was obtained in the same manner as that in the Example 1 except that homopolymer of 2-ethylhexyl methacrylate (EHMA) was used instead of the EA-EA copolymer resin.

The thus prepared toner was charged as negative. Accordingly, +6 KV of voltage was impressed on a surface of the intermediate product same as in the Example 1 by means of a scorotron to make an electrostatic latent image of a binary pattern having a surface voltage of +200 V. Thereafter, the intermediate product was developed and foamed in the same manner as that in the Example 1, thereby obtaining a foamed wall paper having a convexo-concave surface of the Comparison Example 1. However, the liquid toner of the Comparison Example 1 was inferior in dispersion stability.

(Comparison Example 2)

A process same as that in the Example 1 was carried out except that a homopolymer of methyl methacrylate (MMA) was used instead of the EHMA-EA copolymer resin in order to obtain a liquid toner of the Comparison Example 2. However, a macro aggregation occurred, and accordingly the toner was not obtained.

(Evaluation)

The liquid toner and the wall paper obtained in each examples and comparison examples was evaluated in inhibiting effect on a foamed condition, dispersion stability of the toner particles and occurrence of after-yellowing. Further, charge quantity of the copolymer resin particles dispersed in each liquid toner was measured. Results of the evaluations are shown in Table 2 and Table 3.

(1) Evaluation of Inhibiting Effect and After-yellowing

Quality of the inhibiting effect on a foamed condition of the wall paper was evaluated by observing a difference between a thickness of the foamed portion and that of the non-foamed portion. Further, the foamed portion was observed whether the after-yellowing had been caused or not. Criteria for these evaluations are shown as follows.

Evaluation criteria for Inhibiting Effect

○: A highly quality convexo-concave pattern was observed by visual observation.

X: A highly quality convexo-concave pattern was not observed by visual observation.

Evaluation criteria for After-yellowing

○: Discoloration was not observed in comparison with an appearance before heating.

X: Discoloration was observed in comparison with an appearance before heating.

(2) Evaluation of Charge Quantity

A charge quantity of the copolymer resin particles was measured in the following manner. Two electrode plates each of which was made of brass and had a dimension of 5.0 cm in length and 4.5 cm in width were set in a cell for current-measuring which was filled with the liquid toner, and those electrode plates were made to face to each other with distance of 1.0 cm. Then, 1,000 V of voltage was impressed between both the electrode plates by means of a high voltage generator (TYPE 237, manufactured by Keithley Corporation), and then electric current was consecutively measured from a start time of electricity supply to a time when 60 seconds had passed since the start time.

An initially spent charge quantity ($Q_0$) which means charge quantity spent for 60 seconds from a start time of electricity supply was first calculated by integrating the current value from the start time ($I_0$) to the time ($I_{60}$) after 60 seconds. Next, a normally spent charge quantity ($Q_{60}$) which means charge quantity spent for 60 seconds in a stationary state was calculated based on the current value at the time ($I_{60}$) when 60 seconds had passed since the start time of electricity supply. Thus a difference between two of the spent charge quantities (i.e., $Q_0$ and $Q_{60}$) was calculated to determine the charge quantity of the copolymer resin particles (Qt). An equation to be used for the above described calculation can be expressed as follows:

$$Qt=Q_0-Q_{60}=Q_0-(I_{60}\times 60 \text{ seconds})$$

Thereafter, the electrode plates to which solid component of the liquid toner had adhered were picked up from the cell and dried, and then an amount (M) of the solid component stuck on the electrode plates was measured. Thus a specific charge of toner which means a charge quantity per one(1) g of the toner (Qt/M(μc/g)) was calculated based on the measured amount of the stuck solid component (M) and the charge quantity of the copolymer resin particles (Qt).

TABLE 1

| | Copolymer Resin | | |
|---|---|---|---|
| | Kind | Weight Ratio | Foaming Inhibitor |
| Examples | | | |
| 1 | EHMA-MMA | 70/30 | Trimellitic Anhydride |
| 2 | EHMA-MMA | 80/20 | Trimellitic Anhydride |
| 3 | EHMA-EA | 60/40 | Trimellitic Anhydride |
| 4 | EHMA-EA | 70/30 | Benzotriazole |
| Comparison Examples | | | |
| 1 | EHMA | 100 | Trimellitic Anhydride |
| 2 | MMA | 100 | Trimellitic Anhydride |

TABLE 1

| | $\delta p^1$ | $\delta p^2$ | $\delta d$ | $\Delta(\delta p^1-\delta d)$ | $\Delta(\delta p^2-\delta d)$ | $\Delta(\delta p^1-\delta p^2)$ |
|---|---|---|---|---|---|---|
| Examples | | | | | | |
| 1 | 9.2 | 7.7 | 7.3 | 1.9 | 0.4 | 1.5 |
| 2 | 9.3 | 7.7 | 7.3 | 2.0 | 0.4 | 1.6 |
| 3 | 9.2 | 7.7 | 7.3 | 1.9 | 0.4 | 1.5 |
| 4 | 9.2 | 7.7 | 7.3 | 1.9 | 0.4 | 1.5 |
| Comparison Examples | | | | | | |
| 1 | — | 7.7 | 7.3 | — | 0.4 | — |
| 2 | 9.3 | — | 7.3 | 2.0 | — | — |

TABLE 2

| | Charge Polarity of Particles | Dispersion Stability | Inhibition Effect to Foaming | After-yellowing |
|---|---|---|---|---|
| Examples | | | | |
| 1 | Positive | ○ | ○ | ○ |
| 2 | Positive | ○ | ○ | ○ |
| 3 | Positive | ○ | ○ | ○ |
| 4 | Positive | ○ | ○ | ○ |

TABLE 2-continued

| | Charge Polarity of Particles | Dispersion Stability | Inhibition Effect to Foaming | After-yellowing |
|---|---|---|---|---|
| Comparison Examples | | | | |
| 1 | Negative | × | ○ | ○ |
| 2 | — | — | — | — |

TABLE 3

| | Initial Current: $I_0$ (nA) | Current after 60 sec.: $I_{60}$ (nA) | Specific Charge of Toner: Qt/M (μc/g) |
|---|---|---|---|
| Examples | | | |
| 1 | 402 | 385 | 179 |
| 2 | 297 | 250 | 237 |
| 3 | 1047 | 958 | 320 |
| 4 | 892 | 297 | 193 |
| Comparison Examples | | | |
| 1 | 56 | 50 | 87 |
| 2 | — | — | — |

What is claimed is:

1. A liquid toner containing foaming inhibitor comprising fine particles containing a foaming inhibitor affecting a foamable resin composition and an electrically insulating dispersion medium, the fine particles being dispersed in the electrically insulating dispersion medium.

2. A liquid toner according to claim 1, wherein said liquid toner comprises copolymer resin particles and the electrically insulating dispersion medium, the copolymer resin particles containing a copolymer resin composed of at least two different monomer components including a first and a second monomer components and the foaming inhibitor affecting the foamable resin composition, and the copolymer resin particles being dispersed in the electrically insulating dispersion medium, wherein said copolymer resin and said electrically insulating dispersion medium are related to each other such that (i) a difference $\Delta(\delta p^1-\delta d)$ between a solubility parameter value $\delta p^1$ of a homopolymer composed only of the first monomer component in the copolymer resin and a solubility parameter value $\delta d$ of the electrically insulating dispersion medium is not smaller than 1.0, (ii) a difference $\Delta(\delta p^2-\delta d)$ between a solubility parameter value $\delta p^2$ of a homopolymer composed only of the second monomer component in the copolymer resin and a solubility parameter value $\delta d$ of the electrically insulating dispersion medium is not larger than 1.0, and (iii) a difference $\Delta(\delta p^1-\delta p^2)$ between the two solubility parameter values $\delta p^1$ and $\delta p^2$ of those homopolymers is at least 0.5, and each of said copolymer resin particles has a configuration in which a core portion insoluble in the electrically insulating dispersion medium is surrounded with an outer skin portion soluble or swellable in the electrically insulating dispersion medium.

3. A liquid toner according to claim 1, wherein said foaming inhibitor is in a solid state in the ordinary temperature.

4. A liquid toner according to claim 3, wherein trimellitic anhydride and/or benzotriazole is used as said foaming inhibitor.

* * * * *